United States Patent [19]

Keen et al.

[11] Patent Number: 4,881,060

[45] Date of Patent: Nov. 14, 1989

[54] FIRE ALARM SYSTEM

[75] Inventors: Joseph M. Keen, Crystal Lake; David S. Schiller, Hawthorn Woods, both of Ill.

[73] Assignee: Honeywell Inc., Minneapolis, Minn.

[21] Appl. No.: 272,174

[22] Filed: Nov. 16, 1988

[51] Int. Cl.[4] ..... G08B 29/00

[52] U.S. Cl. ..... 340/511; 340/506; 340/531; 340/537; 340/505

[58] Field of Search ..... 340/511, 506, 526, 531, 340/588, 589, 537, 870.01, 870.16, 870.17, 505

[56] References Cited

U.S. PATENT DOCUMENTS

| | | | |
|---|---|---|---|
| 4,459,583 | 7/1984 | van der Walt et al. | 340/511 |
| 4,517,554 | 5/1985 | Moser et al. | 340/511 |
| 4,668,939 | 5/1987 | Kimura et al. | 340/511 |

*Primary Examiner*—Donnie L. Crosland
*Attorney, Agent, or Firm*—Donald J. Lenkszus

[57] ABSTRACT

An improved alarm system and method for use in a fire detection system of the type including at least one sensor for sensing the level of a parameter of a fire condition such as heat or smoke density and which transmits electrical signals indicative of the sensed levels over a communication link. The alarm system and method provides for indicating a first alarm condition by receiving electrical signals from the sensor, keeping time from the time that the parameter reaches a first level, and indicating the first alarm condition when the parameter reaches a second level within a first predetermined time period. The second level has a magnitude greater than the first level. The alarm system and method also indicates a first alarm condition corresponding to a third level of the parameter prior to the third parameter level being reached. A clock keep time from the time that the parameter reaches the first level and alarm means indicates the first alarm condition when the parameter reaches the second level from the first level within a first predetermined time period. The second level has a magnitude greater than the first level and less than the third level.

20 Claims, 4 Drawing Sheets

FIRE ALARM SYSTEM

BACKGROUND OF THE INVENTION

The present invention is generally directed to fire detection systems and more particularly to, an improved alarm system for use in such fire detection systems. The present invention is capable of providing a plurality of alarm indications each associated with a different condition of a remote sensor. The present invention is further capable of providing an advanced warning of an impending fire.

There are many applications in today's industry and commerce for fire detection systems. Such systems are customarily employed, add in fact are generally required by local fire protection laws, in commercial establishments such as factories or office buildings where a large number of people are employed. Such systems are also commonly used in warehouses where valuable inventory is to be protected against loss due to fire.

Fire detection systems used in the commercial environment generally include a plurality of remote sensors which are arranged to sense the level of a parameter of a fire condition such as, for example, heat or smoke density. The remote sensors are distributed throughout the protected area and each sensor is coupled to a central control unit by a communication link. One or more of the remote sensors may be coupled to any given one communication link.

Each sensor is assigned a unique address to permit interrogation by the central control unit and transmits, when interrogated, electrical signals indicative of the level of the parameter being sensed. One common parameter sensed by such sensors is smoke density. The transmitted electrical signal can be, for example, a pulse width modulated signal wherein the length of the transmitted pulse is indicative of the level of the sensed parameter.

The central control unit generally includes software which compares the sensed level received from the sensor to a predetermined fire alarm level or limit. When the level sensed by a remote sensor exceeds the limit, the central control unit will determined the location of the remote sensor by its address, initiate an appropriate fire alarm to evacuate the entire premises or only the affected area, and notify the proper fire department authority.

While fire detection systems of the type referred to above have been generally successful, there remains room for improving their operation and available features. Firstly, such systems are only able to provide an alarm indication when there is an actual fire in process, limiting the amount of time for personnel to evacuate the affected premises. Secondly, current systems are incapable of providing an indication of a situation which is suspected of being a potential fire. Such an indication would allow appropriate maintenance personnel to inspect the relevant area for a condition which may lead to a fire. Such an indication could possibly avoid a fire altogether and, therefore, would not require evacuation by the personnel at that location. Lastly, remote sensors, especially those adapted to sense smoke density, have a tendency to drift in their calibration or to become covered with dust or other particulative matter suspended in the air surrounding the sensors. These conditions can lead to possible false fire indications. It would be most desirable for the fire detection system in which such sensors are employed to have the capability to notify maintenance personnel if one of these conditions exists so that maintenance personnel could provide the appropriate required maintenance to the sensor.

It is therefore a general object of the present invention to provide a new and improved alarm system and method for use in a fire detection system.

It is a further general object of the present invention to provide such a system and method which allows an advanced warning of an impending fire to thereby provide an early fire warning.

It is a further object of the present invention to provide such a system and method which allows a pre-fire condition to be sensed and indicated to afford maintenance personnel an opportunity to rectify a potential fire condition before an actual fire ensues.

It is a further object of the present invention to provide an alarm system and method for use in a fire detection system which allows a required sensor maintenance condition to be detected and indicated to notify maintenance personnel when maintenance of a remote sensor is required.

SUMMARY OF THE INVENTION

The invention therefore provides an alarm system for indicating a first alarm condition in a fire detection system of the type including at least one sensor for sensing the level of a parameter of a fire condition such as heat or smoke density and which transmits electrical signals indicative of the sensed levels over a communication link. The alarm system comprises a control means coupled to the communication link for receiving the electrical signals from the sensor, clock means responsive to the control means for keeping time from the time that the parameter reaches a first level, and alarm means responsive to the control means for indicating the first alarm condition when the parameter reaches a second level within a predetermined time period, the second level having a magnitude greater than the first level. The alarm means may be further responsive to the control means for indicating a second alarm condition when the parameter reaches the second level after the predetermined time period. The first alarm condition may be a pre-fire warning and the second alarm condition may be a maintenance warning indicating that the sensor requires maintenance.

The invention further provides an alarm system for indicating a first alarm condition corresponding to a third level of a sensed parameter prior to the third parameter level being reached for use in a fire detection system of the type including at least one sensor for sensing the level of a parameter of a fire condition such as heat or smoke density and which transmits electrical signals indicative of the sensed levels over a communication link. The alarm system includes control means coupled to the communication link for receiving the electrical signals from the sensor, clock means responsive to the control means for keeping time from the time that the parameter reaches the first level, the first level having a magnitude less than the third level, and alarm means responsive to the control means for indicating the first alarm condition when the parameter reaches a second level within a first predetermined time period, the second level having a magnitude greater than the first level and less than the third level.

The present invention further provides a method for indicating a first alarm condition in a fire detection system of the type including at least one sensor for sensing the level of a parameter of a fire condition such as heat or smoke density and which transmits electrical signals indicative of the sensed levels over a communication link. The method includes the steps of receiving the electrical signals from the sensor and detecting from the received electrical signals if the level of the parameter reaches a first level, keeping time from the time that the parameter reaches the first level, detecting from the received signals if the parameter reaches a second level having a magnitude greater than the first level, determining if the parameter reached the second level from the first level within a first predetermined time period, and indicating the first alarm condition if the parameter reached the second level from the first level within the first predetermined time period.

The method may further include the step of indicating a second alarm condition if the parameter reached the second level from the first level after the expiration of the first predetermined time period. The first predetermined time period may be on the order of two hours and the first alarm condition may be a pre-fire warning and the second alarm condition may be a maintenance warning indicating that the sensor requires maintenance.

The first predetermined time period may instead be on the order of seconds with the first alarm condition being a fire warning and the second alarm condition being a pre-fire warning.

BRIEF DESCRIPTION OF THE DRAWINGS

The features of the present invention which are believed to be novel are set forth with particularity in the pending claims. The invention, together with further objects and advantages thereof, may best be understood by making reference to the following description taken in conjunction with the accompanying drawings in the several figures of which like reference numerals identify like elements, and wherein:

DESCRIPTION OF THE PREFERRED EMBODIMENT

Figure 1:
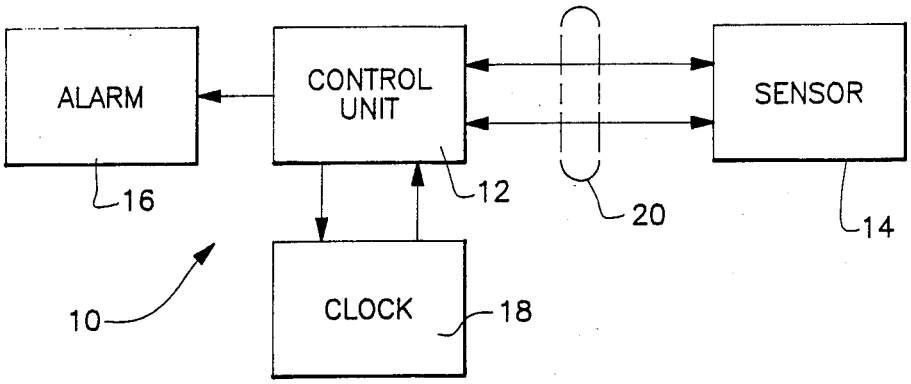
FIG. 1 is a block diagram of a fire detection system embodying the present invention.

Referring now to FIG. 1, it illustrates a fire detection system 10 embodying the present invention. The fire detection system 10 includes a central control unit 12, a remote sensor 14, an alarm 16, and a clock 18. The sensor 14 is coupled to the control unit 12 by a communication link 20 which may be a wire pair, for example. Although just one remote sensor 14 is illustrated in the figure, it will be appreciated by those skilled in the art that a plurality of such sensors may be coupled to the control unit 12 by the communication link 20. Also, control unit 12, alarm 16, and clock 18 are preferably located within a central control station from which the condition of all of the sensors within the protected premises is monitored.

The sensor 14 is preferably a photo sensor or an ion sensor adapted to detect smoke density. Such sensors are well known in the art. Sensors of this type are each provided with a unique address to permit interrogation of the sensors by the control unit 12. Upon interrogation by the control unit 12, the interrogated sensor will send electrical signals to the control unit over the communication link which are indicative of the smoke density level being sensed by the sensor. In accordance with the present invention, the control unit 12 sets three different limits for the sensed smoke density. A first level or limit being a slope check level, the second level being a prealarm or pre-fire level, and the third level being an alarm level. The slope check level is lesser in magnitude than the pre-alarm level and the pre-alarm level is lesser in magnitude than the alarm level.

In determining the smoke density level being sensed by a sensor, the control unit inter rogates the plurality of sensors within the system one at a time in succession and at such a rate that each sensor is interrogated at least once every eight seconds. When control unit 12 determines that an alarm condition exists, it will cause the alarm 16 to indicate a proper alarm condition. For example, if a fire alarm is indicated, the alarm 16 will cause an appropriate alarm to take place in the protected premises to cause evacuation of the premises by the personnel there employed. If a pre-alarm or pre-fire condition is indicated, the alarm 16 will provide a prealarm indication within the central control station to inform maintenance personnel that a pre-fire condition exists so that the maintenance personnel are afforded the opportunity to inspect the premises in the vicinity of the sensor indicating a pre-alarm level to determine if conditions exist which may lead to a potential fire. Lastly, if a maintenance indication exists, the alarm 16 will provide another alarm indication within the central control station to alert maintenance personnel to possible required maintenance of the sensor which indicated the maintenance condition. Such maintenance may require replacement of the sensor or merely cleaning of the sensor.

Figure 2:
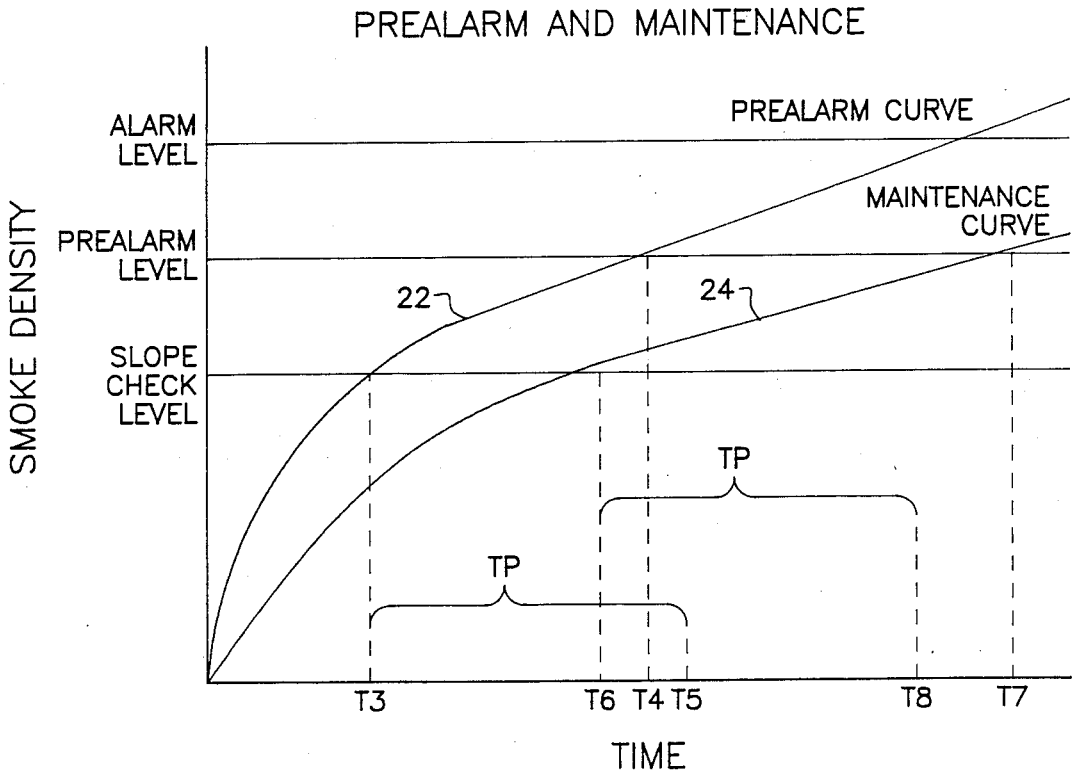
FIG. 2 is a graph of smoke density versus time illustrating a first mode of operation of an alarm system embodying the present invention for two different possible smoke density sensing scenarios.

Referring now to FIG. 2, it illustrates a graph of smoke density versus time illustrating a first mode of operation of an alarm system embodying the present invention which provides a prealarm indication or a maintenance alarm indication. Referring first to curve 22, it will there be noted that the sensor 14 senses smoke density at the slope check level at a time T3. When interrogated by the control unit 12, the sensor 14 will transmit a pulse over the communication link 20 having a pulse width indicative of the analog value (the current smoke density) sensed by the sensor 14. Upon receiving the signal from the sensor 14, the control unit 12 will start the clock 18 at time T3. When the smoke density at the sensor 14 reaches the pre-alarm level at time T4, the control unit will determine that the smoke density level increased from the slope check level to the prealarm level in a time which is less than a predetermined time period TP indicated in the figure as starting at time T3 and expiring at time T5. Since the predetermined time period had not expired and since the smoke density increased from the slope check level to the pre-alarm level within the predetermined time period, the control unit 12 will cause the alarm 16 to indicate a pre-alarm or pre-fire condition.

Referring now to curve 24, it illustrates a scenario where a maintenance alarm indication is necessary. It will be noted that the smoke density reached the slope check level at time T6 and increased to the pre-alarm level at time T7. Because the time between time T6 and T7 is greater than the predetermined time period which ended at T8, the control unit will cause the alarm 16 to provide a maintenance alarm indication. In accordance with this preferred embodiment, the predetermined time period may be on the order of two hours. The maintenance alarm indication indicates that the sensor 14 has either drifted in calibration or has become at least partially covered with dirt or other particulate matter which must be cleaned from the sensor.

The foregoing illustrates that the present invention provides, in accordance with this first mode of operation, an indication of a pre-alarm condition or the maintenance alarm indication. It enables maintenance personnel to determine the nature of the smoke density condition at the sensor 14 and enables maintenance personnel to discern whether an investigation of a potential fire is necessary or whether a sensor merely requires maintenance.

Figure 3:
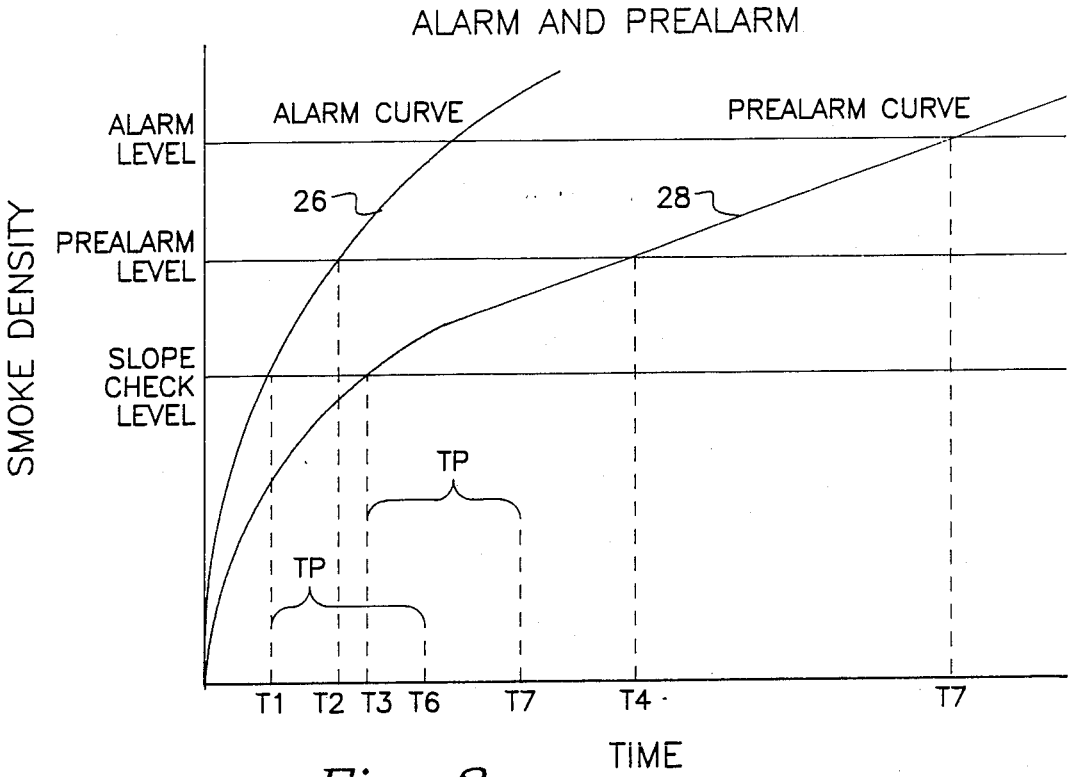
FIG. 3 is another graph of smoke density versus time illustrating a second mode of operation of an alarm system embodying the present invention for two different possible smoke density sensing scenarios.

Referring now to FIG. 3, FIG. 3 is a graph of smoke density versus time illustrating a second mode of operation of an alarm system embodying the present invention. In accordance with this mode of operation, the alarm system indicates either a fire alarm or a pre-fire alarm. Referring first to the curve 26, it will be noted that the smoke density sensed by the sensor 14 reached the slope check level at time T1. The smoke density increased rapidly to the pre-alarm level at time T2. When the smoke density reached the slope check level T1, the control unit started the timer 18. Since the control unit sensed that the smoke density increased from the slope check level to the pre-alarm level in a time from T1 to T2 which is less than the predetermined time from time T1 to time T6, the control unit will cause the alarm 16 to indicate a fire alarm to evacuate personnel from the effected premises. It will be noted that although the smoke density had not reached the alarm level prior to the general fire alarm an actual fire was indicated. This resulted because the control unit was able to determine that the pre-alarm level was reached in a relatively short period of time (the predetermined time period) and accurately predicted that the smoke density would reach the alarm level. Hence, the alarm system of the present invention is capable of providing an advanced warning of an actual fire condition to provide personnel with additional time in which to evacuate the premises.

Referring now to the curve 28, it will be noted that the smoke density reached the smoke check level at time T3. At time T3, the control unit 12 started the clock 18. When the smoke density reached the pre-alarm level at time T4, the control unit determined that the time in which the smoke density increased from the slope check level to the pre-alarm level was greater than the predetermined time period starting from time T3 and ending at time T7. As a result, a general fire alarm was not indicated but control unit 12 caused the alarm 16 to indicate a pre-alarm or pre-fire alarm condition at time T4. As will also be noted in the figure, curve 28 indicates that the smoke density increased to the alarm level at time T5. At time T5 the control unit 12 caused the alarm 16 to indicate a general fire warning to cause evacuation of the effected premises. As a result, the control unit 12 will cause the alarm 16 to indicate a general fire warning anytime the smoke density reaches the alarm level.

As can be noted from FIG. 3, the present invention provides an advanced fire warning in advance of the smoke density reaching the alarm level. In accordance with this embodiment of the present invention, the predetermined time period may be on the order of 30 seconds. With a predetermined time period of 30 seconds, if the smoke density increases from the slope check level to the pre-alarm level within the 30 second predetermined time period, it will be assured that the smoke density will exceed the alarm level within a short period of time. This indicates a steep slope of the smoke density curve indicating that a general fire warning is appropriate even though the alarm level had not yet been exceeded.

As in the previous embodiment illustrated in FIG. 2, the pre-alarm or pre-fire warning indication is provided to alert maintenance personnel to a possible fire condition. This enables maintenance personnel to investigate the area in the vicinity of the sensor 14 and to rectify a potential fire condition in order to prevent an actual fire from ensuing.

Figure 4:
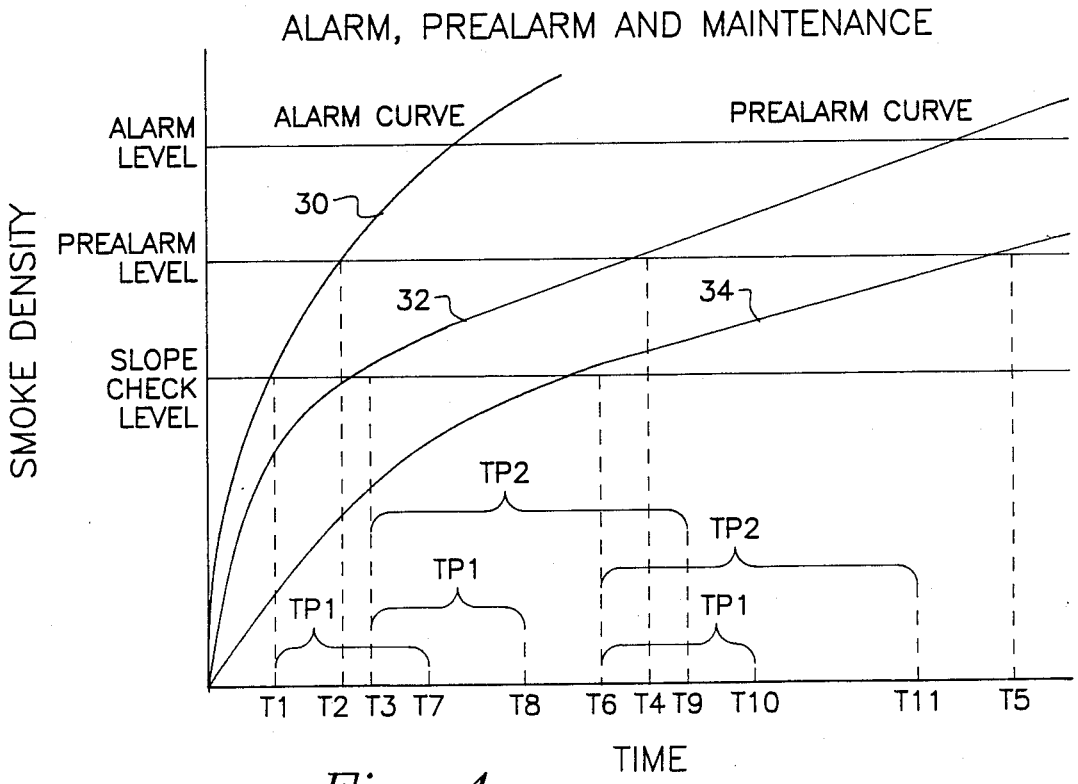
FIG. 4 is a further graph of smoke density versus time illustrating a third and preferred mode of operation of an alarm system embodying the present invention which combines the first and second modes of operation illustrated in FIGS. 2 and 3, respectively, for three different possible smoke density sensing scenarios.

FIG. 4 is a graph of smoke density versus time illustrating a third and preferred mode of operation of the alarm system of the present invention wherein the first two modes of operation as shown in FIGS. 2 and 3 are combined. Referring firstly to the curve 30, it will be noted that the curve 30 is identical to the curve 26 illustrated in FIG. 3. Curve 30 is a curve having a steep slope with the smoke density reaching the slope check level at time T1 and the prealarm level at time T2. Since the time between T1 and T2 is less than a first predetermined time interval ending at T7, control unit 12 will cause the alarm 16 to initiate a general fire warning. The general fire warning is initiated even though the smoke density had not yet reached the alarm level which was reached in a relatively short time. The first predetermined time period may be on the order of 30 seconds.

Referring now to the curve 32, it indicates that the smoke density reached the slope check level at time T3 and the pre-alarm level at time T4. The time interval between time T3 and time T4 is greater than the first predetermined time interval TP1 but less than a second predetermined time interval TP2. The second predetermined time interval TP2 will be on the order of two hours and since the smoke density reached the pre-alarm level from the slope check level after the first predetermined time period and before the expiration of the second predetermined time period, the control unit 12 will cause the alarm 16 to indicate a pre-alarm or pre-fire warning condition. It will also be noted that according to curve 32, the smoke density reached the alarm level at time T5. As a result, at time T5, the control unit 12 will cause the alarm 16 to initiate a general fire warning.

Referring lastly to curve 34, it will be noted that the smoke density reached the slope check level at time T6. After the expiration of both the first predetermined time period TP1 at time T10, and the expiration of the second predetermined time period TP2, the smoke density reached the pre-alarm level. Since the smoke density reached the pre-alarm level from the slope check level after both the first predetermined time interval and the second predetermined time interval, the control unit 12 will cause the alarm 16 to indicate a maintenance warning condition. As in the previous embodiments, the maintenance warning notifies maintenance personnel that the sensor providing the maintenance indication requires maintenance such as replacement or possible cleaning.

From the foregoing embodiment, it can be seen that the present invention provides a plurality of alarm indications, each alarm indication corresponding to a different alarm condition. The alarm system of the present invention is capable of providing a general fire warning, a pre-fire warning, and a maintenance warning. The general fire warning can be initiated before the smoke density reaches an alarm level to provide additional time for personnel to evacuate the affected premises. It also provides maintenance personnel with the capability of distinguishing between a pre-alarm condition or a maintenance condition. This enables maintenance personnel to either rectify a potential fire condition or to provide required maintenance to a sensor to maintain the fire protection integrity of the system.

Figure 5:
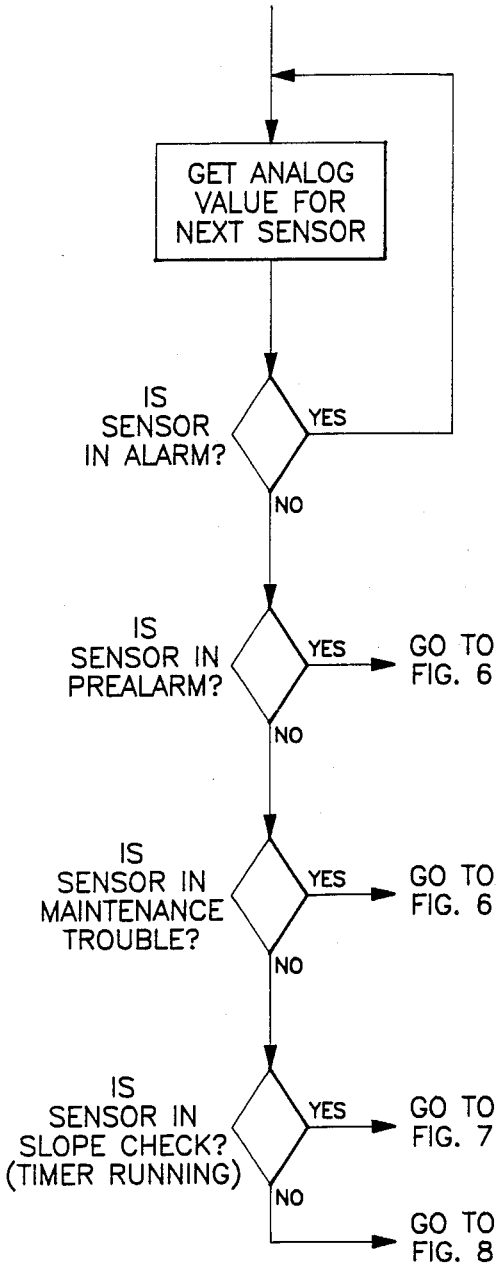
FIGS. 5 through 8 are flow diagrams illustrating the manner of operation of an alarm system embodying the present invention in accordance with the third and preferred mode of operation.
Figure 6:
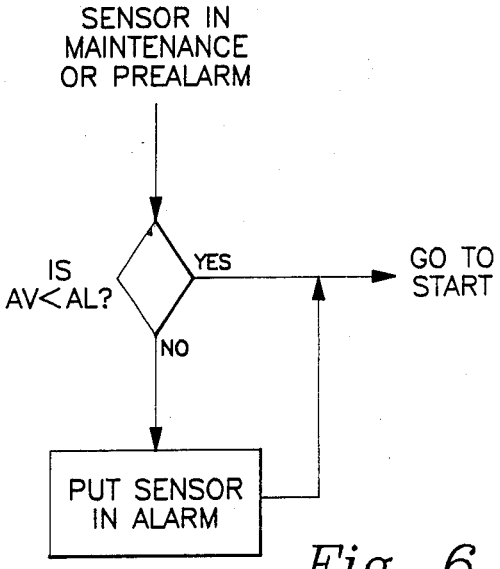
Figure 7:
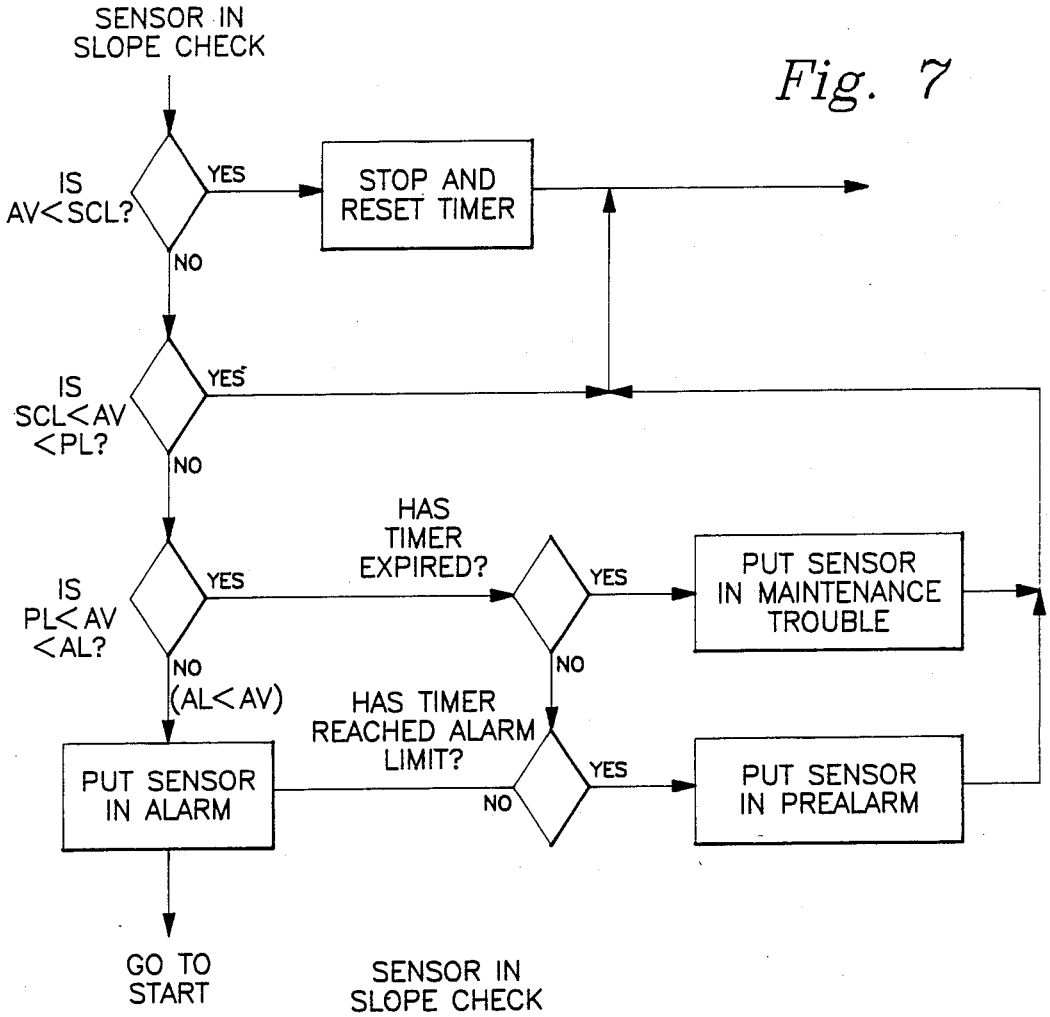
Figure 8:
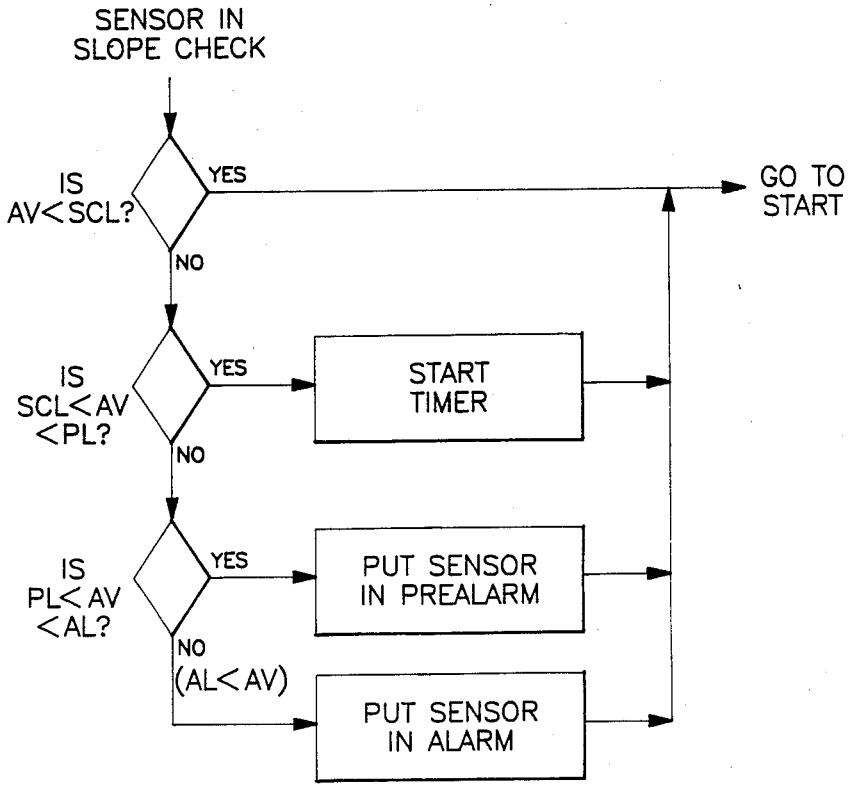

FIGS. 5 through 8 are flow diagrams illustrating the operation of the alarm system of FIG. 1 embodying the present invention in accordance with the third and preferred mode of operation as illustrated by the curves of FIG. 4. As previously mentioned, in actual practice, a plurality of remote sensors would be distributed throughout the protected premises. The sensors are interrogated by the control unit 12 one at a time in succession and at such a rate so that each sensor is interrogated at least once every eight seconds. Accordingly, the flow diagrams, as indicated in FIG. 5, starts with the control unit getting the analog value for the next sensor to be interrogated.

The control unit first determines if the interrogated sensor is in an alarm condition. If it determines that the interrogated sensor is in an alarm condition, then the control unit returns to START to get the analog value for the next sensor. The control unit returns to START in this case because, since an alarm condition has already been indicated, there is nothing else to be done at the moment.

If the interrogated sensor is not in an alarm condition, then the control unit determines if the interrogated sensor is in a pre-alarm condition. If the interrogated sensor is in the pre-alarm condition, then the control unit determines whether the present analog value of the smoke density being sensed, is less than the alarm level. If the smoke density is less than the alarm level, the control unit returns to START because nothing further need be done at the moment. However, if the analog or present value of the smoke density is not less than the alarm value, then it must be greater than the alarm value which causes control unit 12 to place the sensor in alarm and the alarm 16 to initiate a general fire warning.

If the interrogated sensor is not in a pre-alarm condition, then the control unit determines whether the interrogated sensor is in the maintenance condition. If the interrogated sensor is in the maintenance condition, the control unit determines if the analog value or current level sensed by the sensor is less than the alarm level. If the current value indicated by the sensor is less than the alarm limit, then the control unit returns to START. If, however, the analog value is not less than the alarm value, then it must be greater than the alarm level and control unit will cause the alarm 16 to initiate a general fire warning in case there is a fire in progress.

If the interrogated sensor is not in the maintenance condition, then the control unit will determine if the sensor has yet sensed a smoke density equal to the slope check level. If the interrogated sensor had previously sensed a smoke density equal to the slope check level, the control unit 12 will have caused the clock 18 to initiate timekeeping from the moment that the sensor indicated to the control unit that it had sensed a smoke density above the slope check level. If the sensor had previously indicated that the smoke density was equal to or above the slope check level and the clock is running, the control unit will first determine if the analog value presently sensed by the sensor is less than the slope check level. If the analog value is less than the slope check level, this would indicate that the smoke density had decreased to below the slope check level and that there is no longer a need to keep the clock running. As a result, the control unit will stop and reset the clock and then go back to START.

If the analog value is not less than the slope check level, the control unit then determines if the analog value is greater than the slope check level but less than the pre-alarm level. If it is, the control unit will go back to START.

If the analog value is not in between the slope check level and the pre-alarm level, the control unit will then determine whether the analog value is between the pre-alarm level and the alarm level. If it is, this indicates that the smoke density has reached the pre-alarm level. The control unit will then discern whether the second predetermined time period had expired. The second predetermined time period, in accordance with the present invention, is on the order of two hours. The capacity of the clock or timer may be selected to be the predetermined time period. As a result, if the timer has expired, the control unit determines that the smoke density increased from the slope check level to the pre-alarm level in a time greater than the first predetermined time period (30 seconds) and the second predetermined time period (2 hours). As a result, the control unit will place the sensor into the maintenance condition and cause the alarm 16 to indicate a maintenance warning with respect to the sensor being interrogated. The control unit then goes back to START. This corresponds to curve 34 of FIG. 4.

If the timer had not expired, then the control unit determines whether the first predetermined time period has expired. If it has, the control unit places the sensor into the pre-alarm condition and causes the alarm 16 to indicate the pre-alarm or pre-fire warning. The control unit then goes back to START. This corresponds to curve 32 of FIG. 4.

If the first predetermined time period had not expired, then the control unit will place the sensor into the alarm condition and cause the alarm 16 to initiate a general fire warning. The control unit then goes back to START. This corresponds to curve 30 of FIG. 4.

If the control unit determines that the analog value of the interrogated sensor is not in between the pre-alarm level and the alarm level, this would indicate that the analog value is greater than the alarm limit. As a result, the control unit will place the sensor immediately into the alarm condition and cause the alarm to indicate a general fire warning. The control unit then goes back to START.

Returning to the flow diagram of FIG. 5, if the control unit determined that the interrogated sensor had not yet sensed a smoke density level equal to the slope check level, and that therefore the clock or timer was not running, it would then determine whether the analog value of the smoke density sensed by the sensor is less than the slope check level. If it is, the control unit will go back to START.

If the analog value is greater than the slope check level, then the control unit will determine if the analog value is in between the slope check level and the pre-alarm level. If it is, then the control unit will start the clock or timer 18 to initiate timekeeping and then go back to START.

If the analog value is not in between the slope check level and the pre-alarm level, the control unit will then determine if the analog value is in between the pre-alarm level and the alarm level. If it is, the control unit will then place the sensor into the pre-alarm condition and immediately cause the alarm 16 to initiate the pre-alarm or pre-fire warning.

If the analog value is not in between the pre-alarm level and the alarm level, then it must be greater than the alarm level. As a result, the control unit will place the sensor into the alarm condition and cause the alarm 16 to immediately initiate a general fire warning and then go back to START.

From the foregoing, it can be seen that the present invention provides a new and improved alarm system for use in a fire detection system. The alarm system of the present invention provides a plurality of alarm indications, with each alarm indication corresponding to a different alarm condition. For example, as disclosed herein, the alarm system is able to distinguish between a maintenance condition or a pre-alarm condition and provide suitable warning indications for each. In addition, the alarm system of the present invention can distinguish between a pre-alarm condition and a fire alarm condition, wherein the fire alarm condition can be determined prior to the smoke density reaching the fire alarm limit. Lastly, and in accordance with the preferred embodiment, the alarm system of the present invention can incorporate all of the foregoing features to provide an advanced fire warning, prior to the smoke density reaching the alarm level, a pre-alarm warning, and a maintenance warning to permit maintenance personnel to perform required maintenance of the sensor indicating the maintenance condition.

While a particular embodiment of the present invention has been shown and described, modifications may be made and it is therefore intended in the appended claims to cover all such modifications as may fall within the true spirit and scope of the invention.

We claim:

1. In a fire detection system of the type including at least one sensor for sensing the level of a parameter of a fire condition such as heat or smoke density and which transmits electrical signals indicative of the sensed levels over a communication link, an alarm system for indicating a first alarm condition comprising:

control means coupled to said communication link for receiving said electrical signals from said sensor, clock means responsive to said control means for keeping time from the time that said parameter reaches a first level and alarm means responsive to said control means for indicating said first alarm condition when said parameter reaches a second level from said first level within a predetermined time period, said second level having a magnitude greater than said first level.

2. An alarm system as defined in claim 1 wherein said alarm means is further responsive to said control means for indicating a second alarm condition when said parameter reaches said second level from said first level after said predetermined time period.

3. An alarm system as defined in claim 2 wherein said first alarm condition is a pre-fire warning and wherein said second alarm condition is a maintenance warning indicating that said sensor requires maintenance.

4. An alarm system as defined in claim 3 wherein said predetermined time period is on the order of two hours.

5. An alarm system as defined in claim 1 wherein said control means includes means for determining if said parameter reaches said second level from said first level within said predetermined time period.

6. An alarm system as defined in claim 2 wherein said first alarm condition is a fire warning and wherein said second alarm condition is a pre-fire warning.

7. An alarm system as defined in claim 6 wherein said predetermined time period is on the order of thirty seconds.

8. In a fire detection system of the type including at least one sensor for sensing the level of a parameter of a fire condition such as heat or smoke density and which transmits electrical signals indicative of the sensed levels over a communication link, an alarm system for indicating a first alarm condition corresponding to a third level of said parameter prior to said third parameter level being reached, comprising:

control means coupled to said communication link for receiving said electrical signals from said sensor, clock means responsive to said control means for keeping time from the time that said parameter reaches a first level, said first level having a magnitude less than said third level; and alarm means responsive to said control means for indicating said first alarm condition when said parameter reaches a second level from said first level within a first predetermined time period, said second level having a magnitude greater than said first level and less than said third level.

9. An alarm system as defined in claim 8 wherein said alarm means is further responsive to said control means for indicating a second alarm condition when said parameter reaches said second level from said first level after said first predetermined time period and before the end of a second predetermined time period, said second predetermined time period being longer than said first predetermined time period.

10. An alarm system as defined in claim 9 wherein said alarm means is further responsive to said control means for indicating a third alarm condition when said parameter reaches said second level from said first level after said second predetermined time period.

11. An alarm system as defined in claim 10 wherein said first alarm condition is a fire warning, wherein said second alarm condition is a pre-fire warning, and wherein said third alarm condition is a maintenance warning indicating that said sensor requires maintenance.

12. An alarm system as defined in claim 11 wherein said first predetermined time period is on the order of thirty seconds and wherein said second predetermined time period is on the order of two hours.

13. An alarm system as defined in claim 8 wherein said alarm means is responsive to said control means for indicating said first alarm condition whenever said parameter reaches said third level.

14. In a fire detection system of the type including at least one sensor for sensing the level of a parameter of a fire condition such as heat or smoke density and which transmits electrical signals indicative of the sensed levels over a communication link, a method for indicating a first alarm condition, said method including the steps of:

receiving said electrical signals from said sensor and detecting from said received electrical signals if the level of said parameter reaches a first level keeping time from the time that said parameter reaches said first level;

detecting from said received signals if said parameter reaches a second level having a magnitude greater than said first level;

determining if said parameter reached said second level from said first level within a first predetermined time period; and indicating said first alarm condition if said parameter reached said second level from said first level within said first predetermined time period.

15. A method as defined in claim 14 including the further step of indicating a second alarm condition if said parameter reached said second level from said first level after the expiration of said first predetermined time period.

16. A method as defined in claim 14 wherein said first predetermined time period is two hours and wherein said first alarm condition is a pre-fire warning.

17. A method as defined in claim 16 wherein said second alarm condition is a maintenance warning indicating that said sensor requires maintenance.

18. A method as defined in claim 14 including the further steps of determining if said parameter reached said second level from said first level after said first predetermined time period and before the expiration of a second predetermined time period longer than said first predetermined time period and indicating a second alarm condition if said parameter reached said second level from said first level after said first predetermined time period and before the expiration of said second predetermined time period.

19. A method as defined in claim 18 including the further step of indicating a third alarm condition if said parameter reached said second level from said first level after the expiration of said second predetermined time period.

20. A method as defined in claim 19 wherein said first alarm condition is a fire warning, said second alarm condition is a pre-fire warning, and wherein said third alarm condition is a maintenance warning indicating that said sensor requires maintenance.

* * * * *